US005239613A

United States Patent [19]

Motev et al.

[11] Patent Number: 5,239,613

[45] Date of Patent: Aug. 24, 1993

[54] METHOD AND APPARATUS FOR CONTROLLING PRODUCT CURING HEATER

[75] Inventors: Phil Motev, Deerfield; Michael Skrypnik, Chicago, both of Ill.

[73] Assignee: American Screen Printing Equipment Company, Chicago, Ill.

[21] Appl. No.: 819,377

[22] Filed: Jan. 9, 1992

Related U.S. Application Data

[63] Continuation-in-part of Ser. No. 773,486, Oct. 9, 1991.

[51] Int. Cl.[5] ..... F26B 3/30

[52] U.S. Cl. ..... 392/412; 392/415; 392/418; 34/1 W; 34/48; 34/39; 101/115; 101/424.1

[58] Field of Search ..... 392/412–418; 219/388, 492; 34/4, 48, 39, 41, 62, 1 W, 1 BB; 101/115, 114, 424.1, 416.1, 126, 129

[56] References Cited

U.S. PATENT DOCUMENTS

| | | | |
|---|---|---|---|
| 3,465,204 | 9/1969 | Michalski | 315/117 |
| 3,894,343 | 7/1975 | Pray et al. | 34/4 |
| 4,032,817 | 6/1977 | Richmond | 315/157 |
| 4,202,112 | 5/1980 | von der Eltz et al. | 34/4 |
| 4,434,562 | 3/1984 | Bulbley et al. | 34/4 |
| 4,435,637 | 3/1984 | de Vries | 219/497 |
| 4,474,109 | 10/1984 | Yara | 101/115 |
| 4,526,101 | 7/1985 | Ericsson | 101/416.1 |
| 4,545,131 | 10/1985 | Ericsson | 34/52 |
| 4,698,767 | 10/1987 | Wensel et al. | 219/388 |
| 4,773,167 | 9/1988 | Jacobi, Jr. | 34/4 |
| 4,783,908 | 11/1988 | Pabst | 34/4 |
| 5,050,232 | 9/1991 | Bergman et al. | 392/412 |

*Primary Examiner*—Bruce A. Reynolds
*Assistant Examiner*—John A. Jeffery
*Attorney, Agent, or Firm*—Fitch, Even, Tabin & Flannery

[57] ABSTRACT

A control for the electrical curing elements on screen printing apparatus which applies full power to the elements during a heat-up period, and upon attaining a preselected temperature the control switches to a selected lower percentage of full power which continues as long as the apparatus continues to index through its printing cycles.

17 Claims, 6 Drawing Sheets

FIG.2
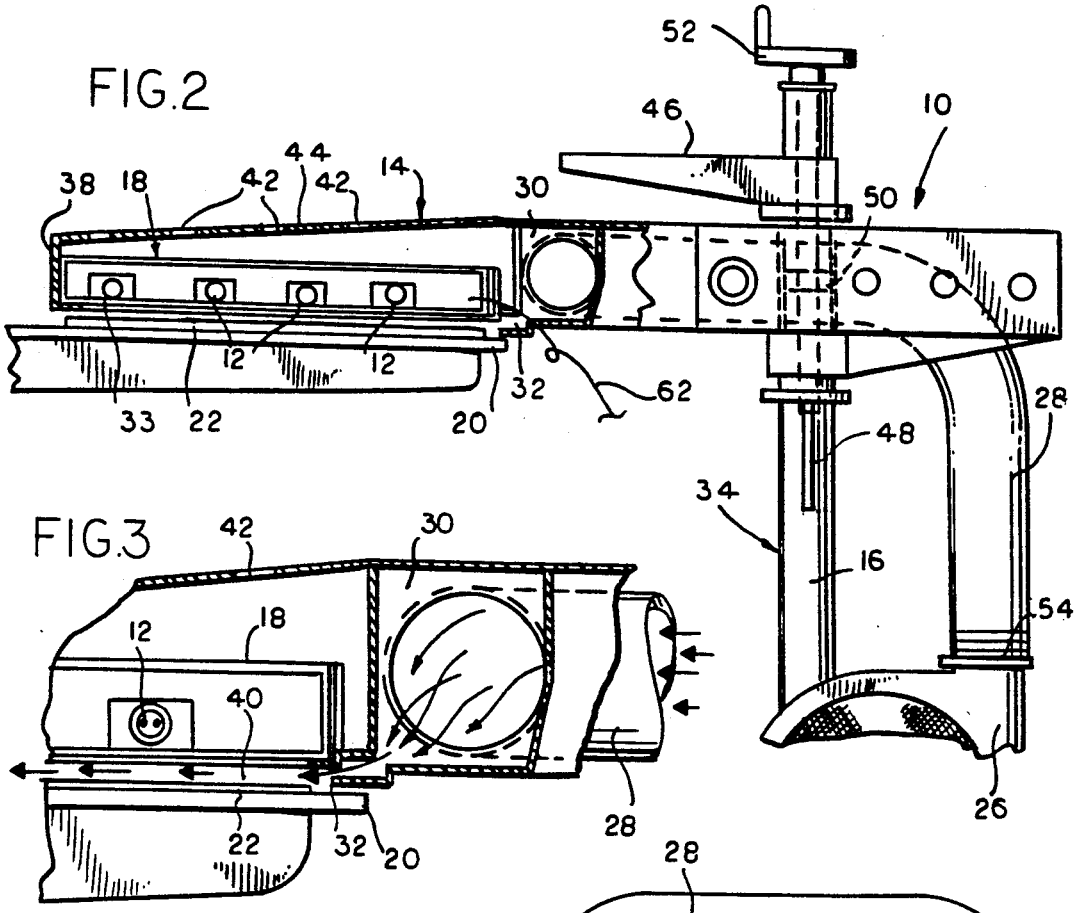
FIG.3
FIG.4
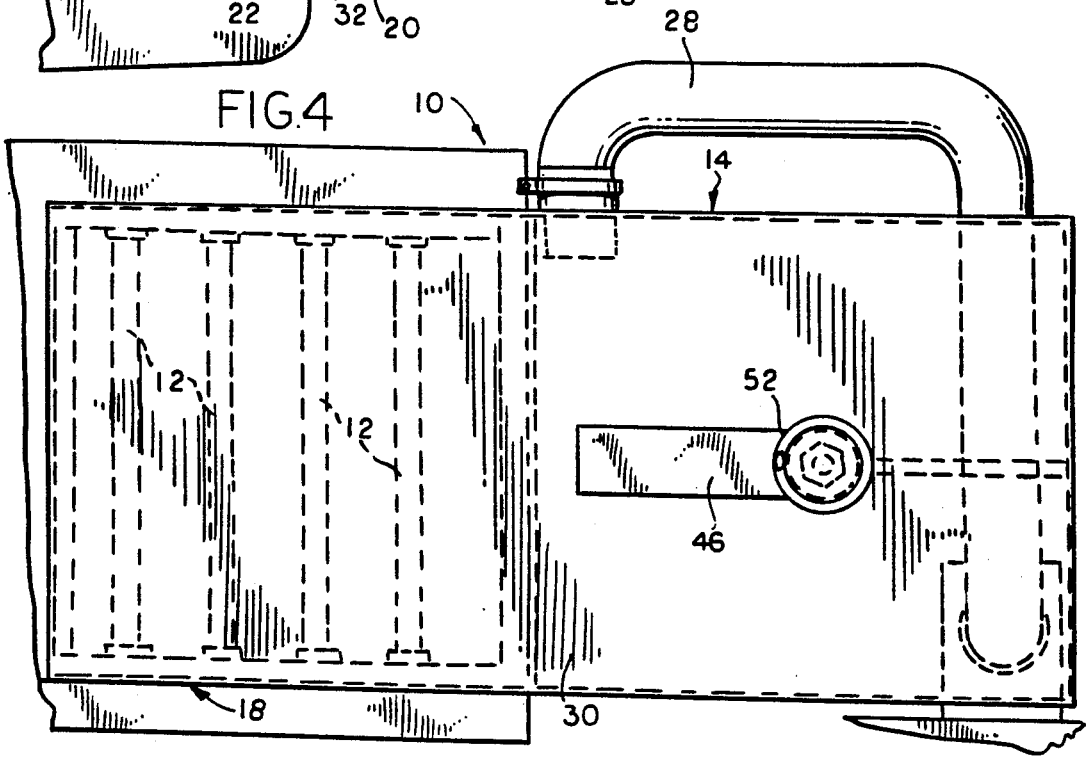

FROM FIG.8
L1
L2
L3
240V
240V
L2
L1
M4
M5
M6
M1
126
F11
C1
C1
C1
S4
87
S7
85a
L3
112C
SLEEVE HEAT ZONE 01
85b
112f
L8
WAIST HEAT ZONE 01
S5
87
N
S8
85C
L4
112d
SLEEVE HEAT ZONE 02
85d
112g
L9
WAIST HEAT ZONE 02
78
83
87
S6
R5
S9
87
85e
L5
112e
SLEEVE HEAT ZONE 03
85f
112b
L10
WAIST HEAT ZONE 03
112
78
N
TO FIG. 10

METHOD AND APPARATUS FOR CONTROLLING PRODUCT CURING HEATER

CROSS-REFERENCE TO RELATED APPLICATION

This is a continuation-in-part of co-pending U.S. patent application Ser. No. 773,486, filed Oct. 9, 1991, which is hereby incorporated by reference as if fully reproduced herein.

FIELD OF THE INVENTION

This invention relates to a method and apparatus for controlling the drying or curing of inks, and more particularly, to a method and apparatus for controlling and regulating the power applied to electrical resistance heating for drying or curing screen printed ink on a material such as a textile.

BACKGROUND OF THE INVENTION

Conventional silk screen presses print multi-colored images on material by mounting the material to a platen and rotating the platen past each of a plurality of print units, located peripherally about a central support, wherein each print unit prints a different color. The images printed at the several print units, when superimposed one over the other on the material, produce the desired multi-colored work. It is important in multi-colored apparatus of this type to completely cure, or dry, the ink applied at a previous station prior to application of a differently colored ink at a subsequent station. Curing between successive ink applications is sometimes necessary or desirable in order to avoid smearing or blurring of the previously printed image upon printing of a subsequent image thereupon. It is known to utilize electrical resistance heating elements situated in proximity with the printed material, or workpiece, which impart radiative and convective heat to the printed material between successive printing operations sufficient to cure the print thereon. Since only a thin layer of ink is applied in silk screening applications, the required heat exposure time for curing is relatively short. Overheating of the printed work may result in wrinkles, discoloration, shrinkage, and/or scorching of both the applied ink and the underlying material. Therefore, it is important that the heat application be closely controlled.

Normally, only a thin layer of ink is applied in screen printing operations, and exposure to ambient air is sufficient to adequately cure or dry the applied ink. However, certain applications require a heavier layer of applied ink. For instance, before printing fluorescent ink upon a black material such as a T-shirt, it is necessary to apply a heavy layer of white ink to completely cover up the black substrate. Thus, curing is generally necessary immediately following such a white layer print unit at which the heavy layer of white ink is applied.

The heat generated by electrical resistance heaters increases with time upon application of a given voltage, so that the heating elements require time to reach their point of maximum heat emission. A particular problem with current designs is that they are not able to reconcile the conflicting goals of providing maximum heating during curing and interruption of heat to the printed material between curing operations, without significantly reducing production speed. Two alternative methods are employed in current curing apparatus.

Either the heating elements are maintained at a constant high heating level so that no time is lost in bringing the heating elements back up to their maximum level, or else the voltage supplied to the heating elements is completely interrupted between curing operations and reapplied during curing. Both designs have been found to be inadequate. Maintaining the heating elements at high voltage has been found to cause high heat build-up, and if the apparatus is stopped from indexing the workpiece, a paper or textile workpiece can be subjected to sufficient heat to scorch or to catch fire. To prevent scorching or burning of the material when the indexing movement is stopped, the voltage may be interrupted. However, interruption of the voltage to the heating elements between curing operations is undesirable in that production speeds are limited by the time required for the heating elements to reattain their maximum heating level upon reapplication of electrical power thereto.

In use, the curing elements are usually set at their maximum full power position during start-up to heat the curing elements to their operating temperature which can be varied substantially by operation of a power control means such as a manually operable rheostat. For example, when the power is set at full power, i.e., 100% power, the maximum temperature achieved is on the order of 380° F. to 400° F. within thirty or more seconds. Usually, the operator will adjust the rheostat to a percentage, e.g., 50% of full power, to operate at a lower temperature, for example, 250° F., to accommodate for various parameters such as the particular inks being cured, the kind of workpiece being printed, and ambient conditions. The exact settings of power are based on trial and error and experience. Whenever there is an interruption in the usual printing cycle, the power is interrupted completely or reset to a very low level of power, e.g., 25% of full power, to prevent damage to the workpiece in the curing station. After the interruption is over, the operator usually turns the rheostat to full power so that the heating elements will heat more quickly to a temperature needed to cure the ink. The operator will, after a short interval, return the rheostat to the previous setting and begin cycling the screen printing machine. If the operator is not careful and forgets to return the rheostat to the desired lower percentage of power, the workpieces may be damaged by the too high temperature curing conditions until the operator recognizes his mistake.

In co-pending application, Ser. No. 773,486, entitled "Resin Curing apparatus and Method Utilizing Infrared Lamp and Blower Control Means", filed Oct. 9, 1991, there is disclosed and claimed apparatus in which the voltage supplied to the heating elements during the intervals between curing operations is dropped to a fraction of the curing voltage, and a thin layer of high velocity air is simultaneously blown between the heating elements and the workpiece. The airflow rate is sufficient to dissipate the low heat generated by the heating elements at the reduced voltage, and any residual heat from the heating elements and their housing, away from the workpiece. The airflow also increases convection at the workpiece surface, which further assists in the cooling thereof between curing operations. While a predetermined full voltage sufficient to effect curing is supplied to the heating elements during curing, the voltage is reduced to approximately one quarter of full voltage between curing operations and during production interruptions and, during such periods of low voltage, air is blown between the apparatus and printed material. Upon resumption of normal operation, full voltage is resumed and the airflow discontinued.

In the apparatus disclosed in the above cited application, the supplied voltage is alternated between high and low levels, and the blower turned on and off, based upon signals sent from a programmable control panel. Quartz tubes or similar electrical resistance heating elements are employed which allow operation under both partial and full voltages with the heat generated by the tubes proportional to the applied voltage. During periods of production interruption, a reduced voltage continues to be supplied to the heating elements. This allows the heating elements to reattain their maximum heating level more rapidly upon reimposition of full voltage than designs wherein the voltage to the heating elements is completely interrupted between curing operations. This apparatus may also be supplied with a rheostat or other power control device that can be set a fraction of full power for normal curing and then manually reset to full power to heat the quartz tubes rapidly. The operator must then remember to reset the rheostat to the desired percentage of full power to avoid damage to the workpieces.

Although the apparatus disclosed in the above cited application solves many then-existing problems in curing workpieces in screen printing presses, the lowering of the voltage during production interruptions and operating the heating elements at maximum voltage during curing operations presents some problems in controlling the uniformity of the curing operation and adapting to varying needs for different production processes.

SUMMARY OF THE INVENTION

In accordance with the present invention, there is provided a control for regulating the heating elements of the curing apparatus for a screen printing press whereby the amount of heat energy necessary for curing the ink applied to a workpiece may be accurately controlled during rapid indexing cycles and the problems associated with residual heat build-up during periods of production interruption are eliminated even though the heating elements are operated substantially continuously.

The heat energy for curing a particular workpiece is obtained by operating the heating elements at a selected percentage of full power as regulated by the solid state control so as to completely cure the workpiece during the residence time in the curing station. By employing the fan means associated with the heating elements, it is possible to operate the heating elements continuously during curing cycles at the selected percentage of full power without experiencing an unacceptable residual heat build-up or accumulation. Since the cycle times associated with such automatic indexing machines are very short, the maintenance of the heating elements at a constant power results in little energy loss and in an accurately controlled rapid curing cycle.

The heater control includes temperature control means that provides full power for the initial heat-up of the heating elements to minimize the time required for this initial heat-up. When the heating elements have attained a predetermined temperature, the controller automatically drops the power level supplied to the heating elements to a preselected lower level. The controller then operates the heating elements continuously at this lower level as long as the proper indexing signal is received indicating that the workpiece is moving into and out of the curing station in the apparatus with the appropriate residence time in the curing station to cure the workpiece.

In the event the automatic printing apparatus fails to index in a timely manner, an internal timer commences a "time out" cycle. At the end of a predetermined short interval for which the timer is set, the power circuit to the heating elements is shut down if the normal indexing has not begun again. Thus, by operating the heating elements at a reduced power level, satisfactory curing is accomplished during the normal machine cycle and overheat problems are avoided by including the shutdown mechanism. The over-heat problems are further minimized by utilizing continuously operating fan cooling means. Although the prior copending application, Ser. No. 773,486, contemplated energizing the cooling fan during periods of production interruption, the present application contemplates operating the fan continuously.

By designing the heating elements to be operated at less than full power, the control system is more flexible in providing the optimum curing heat for any particular situation. In addition, the operation of the heating elements at full power during heat-up after a period of interruption shortens the time required for such heat-up. The automatic switching of the control circuit from the high heat to low heat after the heating elements have reached a predetermined temperature eliminates the risk of an operator forgetting to reduce the power after heat-up. Thus, the control circuit of the present invention is simple and effective in providing accurate curing times without overheating occurring to adversely affect the process. The aforementioned heat accumulation problems associated with a continual electrical supply to the heating elements are eliminated in apparatus constructed according to the present invention. Since the heating elements are exposed to a stream of forced air passing thereover, the heat generated by the heating elements during production interruptions of limited duration is dissipated away from the workpiece sufficiently to prevent the workpiece from being overheated any significant amount.

Accordingly, it is an object of the present invention to provide improved method and apparatus for curing ink deposited on textile materials by a screen printing process wherein electric heating elements are operated continuously at a reduced power level.

It is another object of the present invention to provide improved ink curing apparatus utilizing heating elements operating continuously at a reduced power level during normal cycling of a screen printer and having control means which operate the heating elements at full power during heat-up and automatically reduce the heating element power to the reduced power on reaching a set point temperature.

It is a further object of the present invention to provide improved ink curing apparatus utilizing heating elements operating continuously at a reduced power level with curing time controlled by the machine indexing and fan cooling means provided for the heating elements to prevent heat build-up in the area of the heating elements.

This invention will be more fully understood and further objects and advantages thereof will become apparent in the following detailed description of preferred embodiments of the invention illustrated in the accompanying drawings.

BRIEF DESCRIPTION OF THE DRAWINGS

Wherein like elements are referenced alike:

FIG. 2 is an enlarged, cross sectional view of the upper portion of the apparatus of FIG. 1;

FIG. 3 is an enlarged, fragmentary view of the plenum portion of the view of FIG. 2, particularly illustrating the path of airflow;

FIG. 4 is an enlarged top view of the apparatus of FIG. 2;

DETAILED DESCRIPTION OF THE PREFERRED EMBODIMENT

Figure 1:
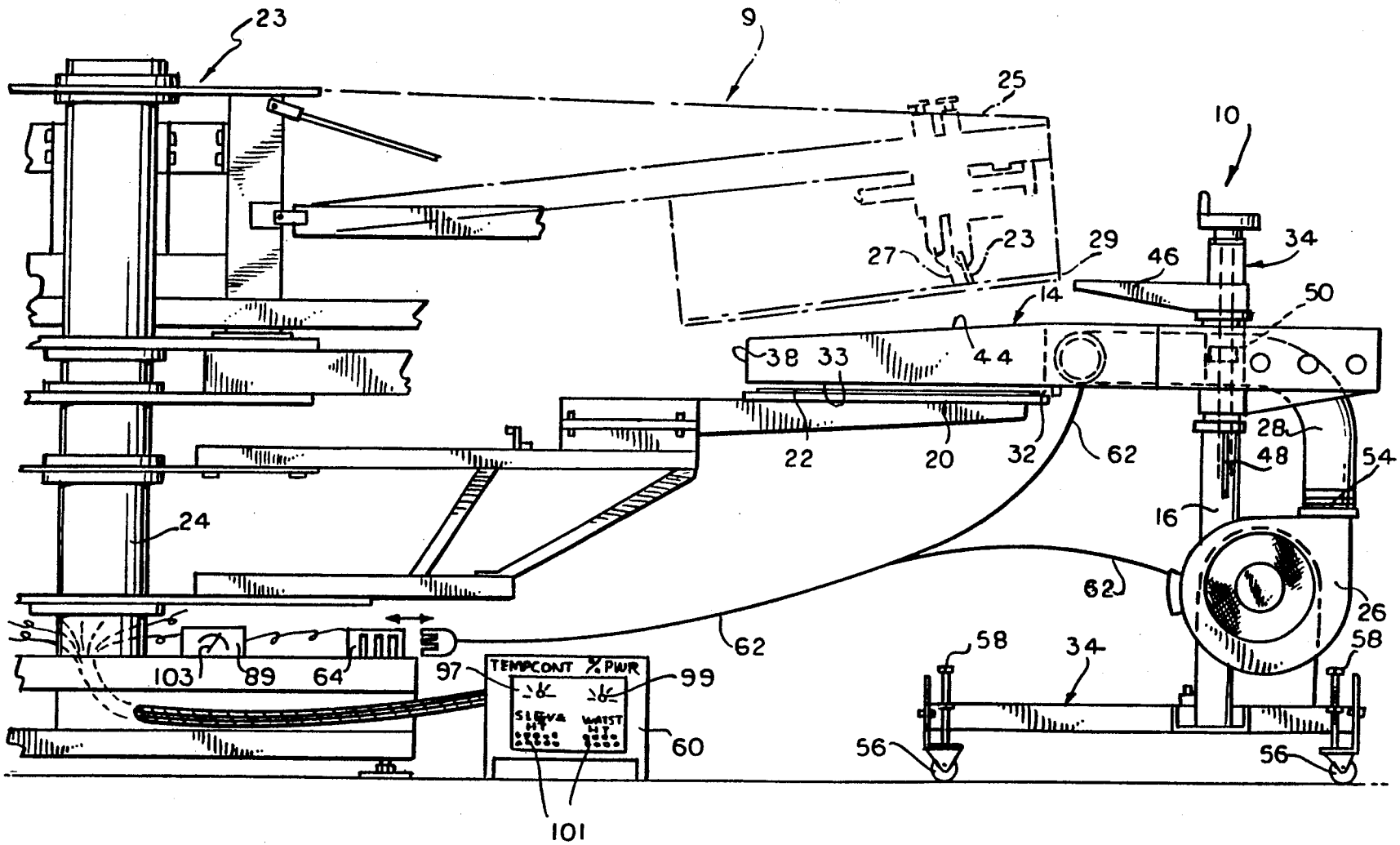
FIG. 1 is an illustration of a printing and curing apparatus to which the method and apparatus of the present invention for controlling product curing is applied.

There is shown in FIGS. 1–4 a printing and curing apparatus designated generally by reference numeral 9 to which the control method and apparatus of the present invention is applied. It should be understood that the apparatus 9 is an automatic rotary printing apparatus having a number of peripherally disposed loading, printing and curing stations through which a workpiece such as a T-shirt on a palette is automatically indexed to have sequential printing and curing or drying operations performed. The invention relates to the control of the heaters for curing the ink or resin applied to the workpiece and would be applicable to other types of automatically indexing printing machines.

The apparatus 9 includes heat curing apparatus 10 and a screen printing press 23. The heat curing apparatus 10 includes a plurality of heating elements which are quartz tube type resistance heating elements 12. The heating elements 12 are supported by a generally horizontal arm 14 which is, in turn, supported upon a vertical column 16. The plurality of quartz tubes 12 are located in a tube bed 18 which is removably attached to the horizontal arm 14 at a point distant from the vertical column 16. The arm 14 and tubes 12 are spaced above a platen 20 and workpiece or material 22 which pass below the tubes. The arm 14 is cantilevered over the platen and this allows the rotary platens 20, upon which material 22 to be printed is conventionally mounted, to sequentially pass beneath the tube bed 18 without contacting the vertical column 16. (see FIG. 1)

In the screen press 23, a plurality of platens or palettes 20 rotate about a central column 24 and sequentially carry the material 22 mounted thereon into registration with printing heads 25 including a squeegee 23 and flood bar 27, the printing heads being located peripherally about the central column 24. The tube bed 18 portion of the curing apparatus 10 is positioned so as to also be in registration with one of the platens 20 when the platens are at rest and the printing heads 25 are positioned to print at the other stations where no curing apparatus is present. Thus, the apparatus 10 cures the material 22 after it has been printed upon at a preceding station and is rotated into registration at an open, non-printing station at which is located the tube bed 18 portion of the apparatus. That is, while the several materials in registration with their respective printing units are undergoing printing operations, the printed material in registration with the curing apparatus 10 is simultaneously undergoing curing.

Curing is attained by supplying electric power to the quartz tube heating elements 12 while the printed material is situated therebeneath, which causes the tubes to become hot and impart heat to the printed material 22 to effect curing. The maximum temperature which the quartz tubes 12 will reach varies in proportion to the voltage or power supplied thereto. Many of the solid state controls presently used vary the power rather than the voltage to provide less than full power with proportional controls which allow only a portion of each alternating voltage cycle to pass to the load. The power applied to the tubes 12 is variable, and the optimal power level to be supplied will vary depending upon the specific application. Thus, after a material 22 has been printed upon, and advanced to a position beneath the extending tube bed 18, a predetermined electrical power is supplied to the tubes 12 for a period sufficient to effect curing of the printed material. The selected power level will vary depending on the index cycle time during which the material will remain in the curing station, and the materials being cured and other parameters particular to the application at hand.

In order to provide very rapid initial heat-up of the quartz tubes 12 and to provide flexibility in curing many types of materials, it is contemplated that the quartz tubes 12 would have a heat output well in excess of that needed to cure the materials during the normal residence time in the curing station or position. As a consequence, the electric power delivered to the quartz tubes during the curing operation is on the order of 30 to 50 percent of the full power level. By selecting an appropriate power level and applying it at a constant level during the entire cycle that the material is in the curing station, a uniform curing process is assured.

As will be explained in detail below, the automatic control means for the heating elements provides full power to the heating elements during heat-up and then automatically switches to the low power level, which continues as long as the apparatus continues its normal cycling. During the periods between the curing cycles, the heating elements continue to be operated at the lowered power level.

To prevent the buildup of residual heat in the tube bed 18 and the surrounding portions of the apparatus 10 particularly during interruptions in the cycling of the apparatus, there is provided a blower 26. The blower 26 is actuated to induce a flow of air between the tube bed 18 and the printed material 22. Conduit 28 extends from the blower 26 to the plenum portion 30 of the horizontal arm 14. A slotted opening 32 is provided in the plenum portion 30 through which the air from the blower 28 can exit the plenum 30 as a sheet of airflow. The slot 32 is configured so as to direct the airflow generally along the underside 33 of the tube bed 18, whereby the air passes between the apparatus 10 and the printed material 22, generally parallel to the underside 33 of the tube bed 18. With the quartz tubes 12 at a reduced power level, the sheet of air passing across the lower face of tube bed 18 is sufficient to prevent significant residual heat build-up.

As seen in FIG. 2, the tube bed 18 is removably mounted near the free end 38 of the cantilevered horizontal arm 14, and it extends out over the platens 20 rotating therebeneath. Removability of the tube bed 18 is desirable to allow for replacement of individual quartz tubes 12 therein, or replacement of the entire tube bed 18 as a whole, as may be required. The underside of the horizontal arm 14 is provided with an opening which extends from the free end 38 of the horizontal arm 14 to the plenum portion 30, and across the width of the tube bed 18 as well. This opening allows unimpeded heat flow from the underside 33 of the tube bed 18 to the printed material 22. To prevent pressure build-up associated with the aforementioned air expansion and heat accumulation in the region above the tube bed 18, vents 42 may be provided in the upper surface 44 of the horizontal arm 14 to allow ventilation therethrough.

By operating the tube bed at a reduce power level so that curing is completed during the entire residence time of the workpiece in the curing station, the cooling effect provided by the blower 26 is not intended to primarily protect the printed material 22, but is mainly to prevent the build-up of residual heat on the parts exposed to the continuous radiant heat of the quartz tubes 12. While the continuous operation of the blower 26 reduces the heating produced by the quartz tubes 12 during the curing operation, the primary heating by the quartz tubes 12 in curing the ink or resin on the workpiece is by infrared radiation which is not materially affected by the circulating air.

Figure 5:
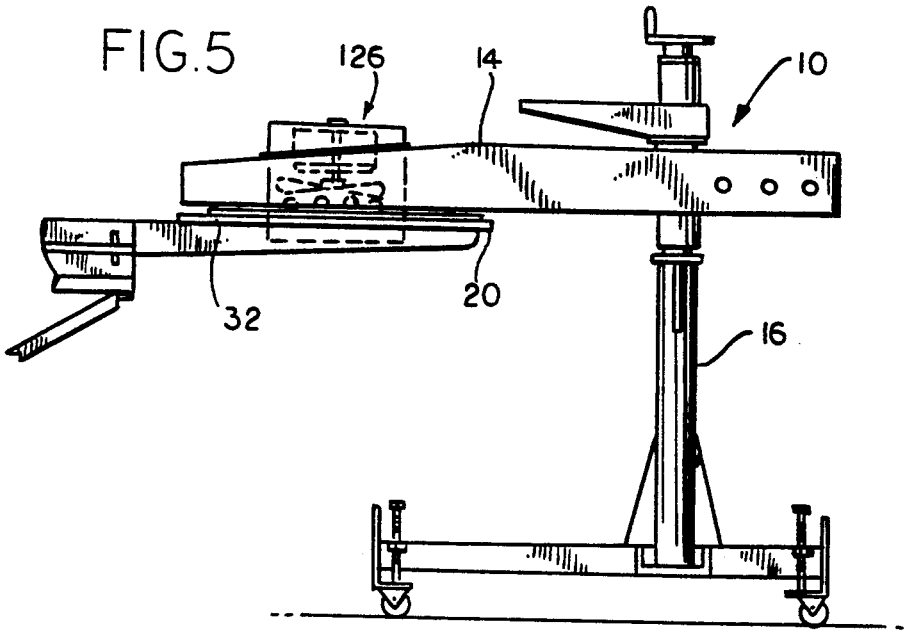
FIG. 5 is a side elevational view of an alternative embodiment of the curing apparatus with a modified blower.
Figure 6:
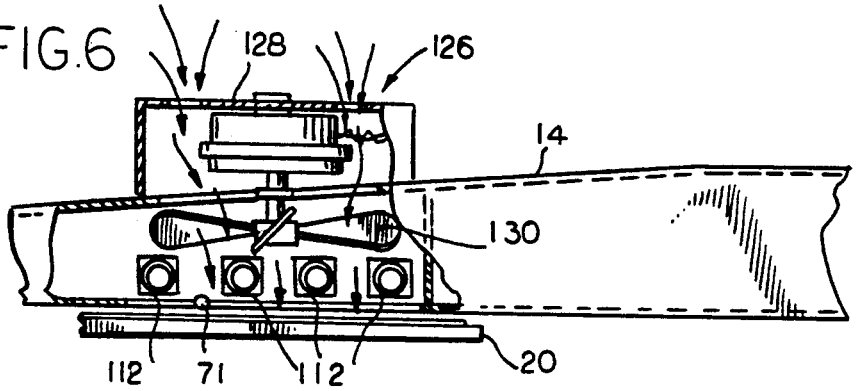
FIG. 6 is a fragmentary enlarged view partially in section of a portion of the curing apparatus of FIG. 5.

Referring to FIGS. 5 and 6 of the drawings, there is shown an alternative embodiment of the blower 26. In the embodiment of FIGS. 5 and 6, a motor driven fan 126 is mounted directly above the quartz tubes 12 to circulate air downwardly across the tubes 12 as shown by the arrows in FIG. 6. The unit 126 includes a small motor 128 driving a fan 130. Depending on the size and arrangement of the quartz tubes 12, it may be desirable to have a total of four such motor driven fans 126 circulating air downwardly through the quartz tubes 12. The fan or fans 126 circulate air at a low velocity to provide a uniform temperature across the workpiece 22 as well as preventing the build-up of residual heat.

Figure 7:
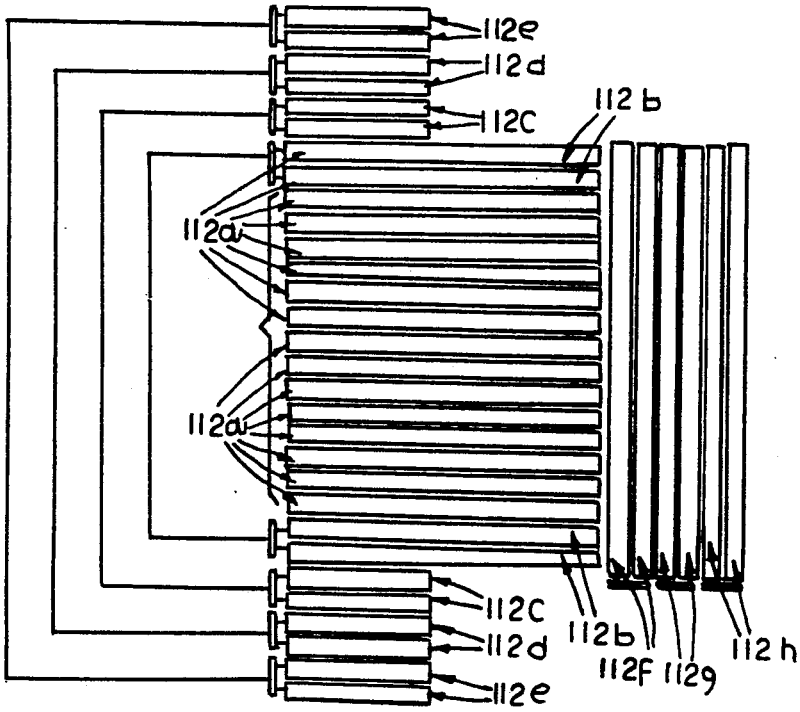
FIG. 7 is a plan view of the heating element layout of the curing apparatus.

As discussed in co-pending application Ser. No. 773,486, the heating elements 12 are preferably arranged in a T-shaped configuration as shown in FIG. 7, with switch means provided to selectively energize various combinations of heating elements to cure workpieces of different sizes and configurations. The central portion of the T-shaped configuration is heated by a series of 14 parallel quartz tube elements 112*a* which are normally energized. Adjacent the central portion on either side thereof are a first set of selectively operable sleeve elements 112*b*, a second set of selectively operable sleeve elements 112*c*, a third set of selectively operable sleeve elements 112*d*, and a fourth set of selectively operable sleeve elements 112*e*. Running perpendicular to the elements of the central portion and adjacent thereto are selectively operable sets of waist elements comprising a first set 112*f*, a second set 112*g* and a third set 112*h*. As is more completely explained in the co-pending application, the switch means is associated with each set of elements permitting energizing appropriate quartz elements to cure the various sized designs printed on the workpiece being processed.

The tube bed 18 and blower 26 may be mounted on a caster supported portable stand 34 to allow the apparatus 10 to be wheeled to any desired location about a screen press 23 as desired to suit a given application. Normally, the curing apparatus 10 will be placed at a location formerly occupied by a printing head, which head has been lifted out of position (see phantom lines in FIG. 1). Thus, after a printing head 25, including the squeegee 23, flood bar 27 and silk screen 29, is lifted upwards, the tube bed portion 18 of the apparatus 10 is inserted underneath the printing head 25. As the platens 20 come to rest with the plurality of printing heads printing upon the respective materials 22 therebeneath, one of the platens 20 supporting printed material 22 will be beneath the cantilevered tube bed 18. Accordingly, while the printing heads are printing upon the material at the printing stations, the curing apparatus 10 cures the printed material at the curing stations.

In the majority of screen printing applications, it is sufficient for the ink to be applied thinly. With such a thin layer of ink, drying thereof is attainable merely by exposure to ambient air for a short time. However, for heavier paint applications, a separate curing apparatus is required to dry the printed material prior to a subsequent printing thereupon. Normally, the printing head is removed, and the curing apparatus 10 inserted, at the printing station immediately following a station at which the heavy layer of ink is applied. One example of where heavier ink applications are required is the application of white ink upon a black material prior to applications of fluorescent ink at subsequent printing stations. A heavy layer of ink is required in such applications to completely cover the substrate. Accordingly, the following station to which the printed material 22 is subsequently transported will have a curing apparatus 10 inserted thereat to cure the printed material prior to its being moved to a subsequent station at which it will undergo an additional printing operation.

Figure 8:
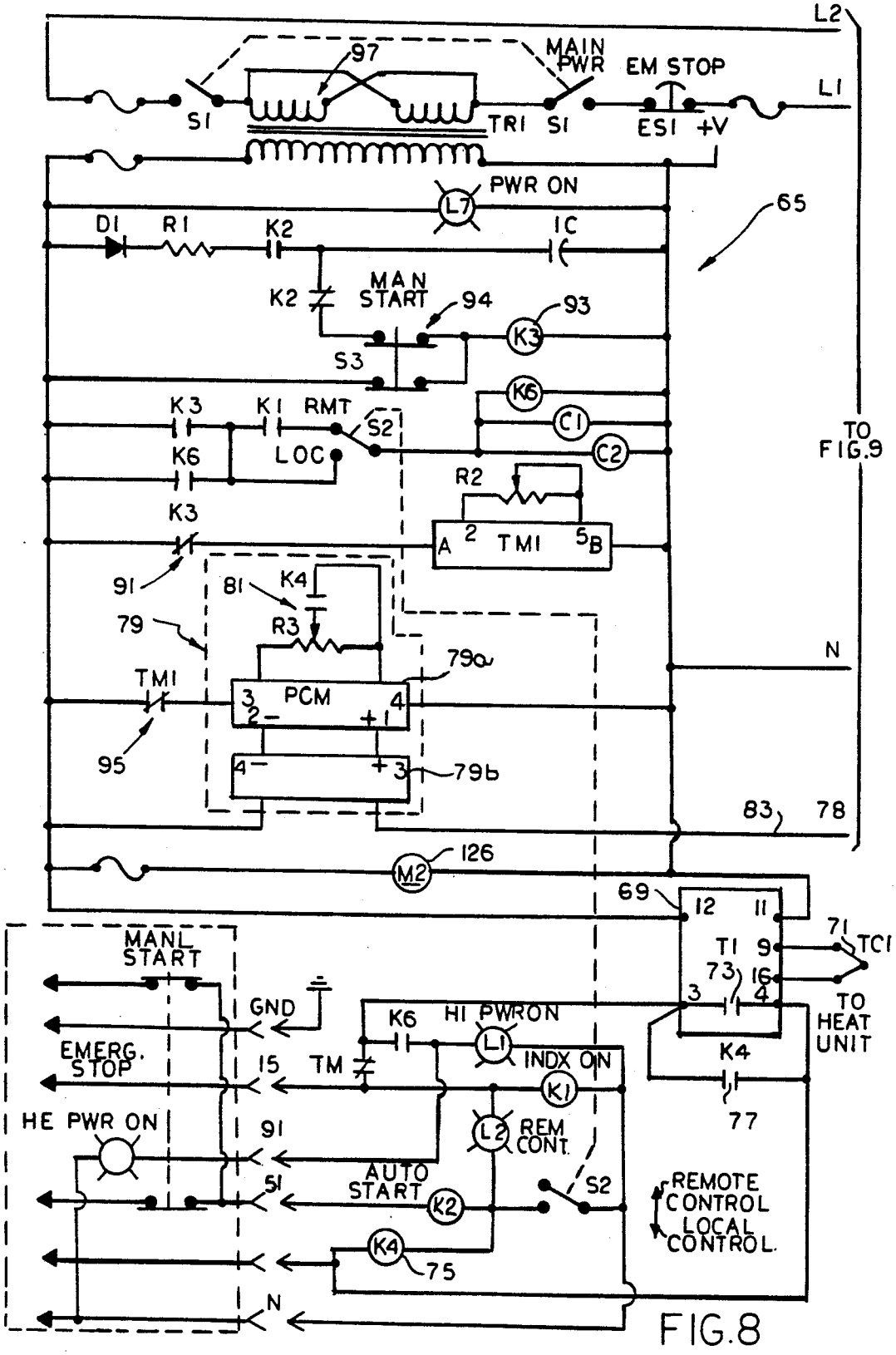
FIG. 8 is a schematic circuit diagram of the control for the heating elements of the curing apparatus.
Figure 9:
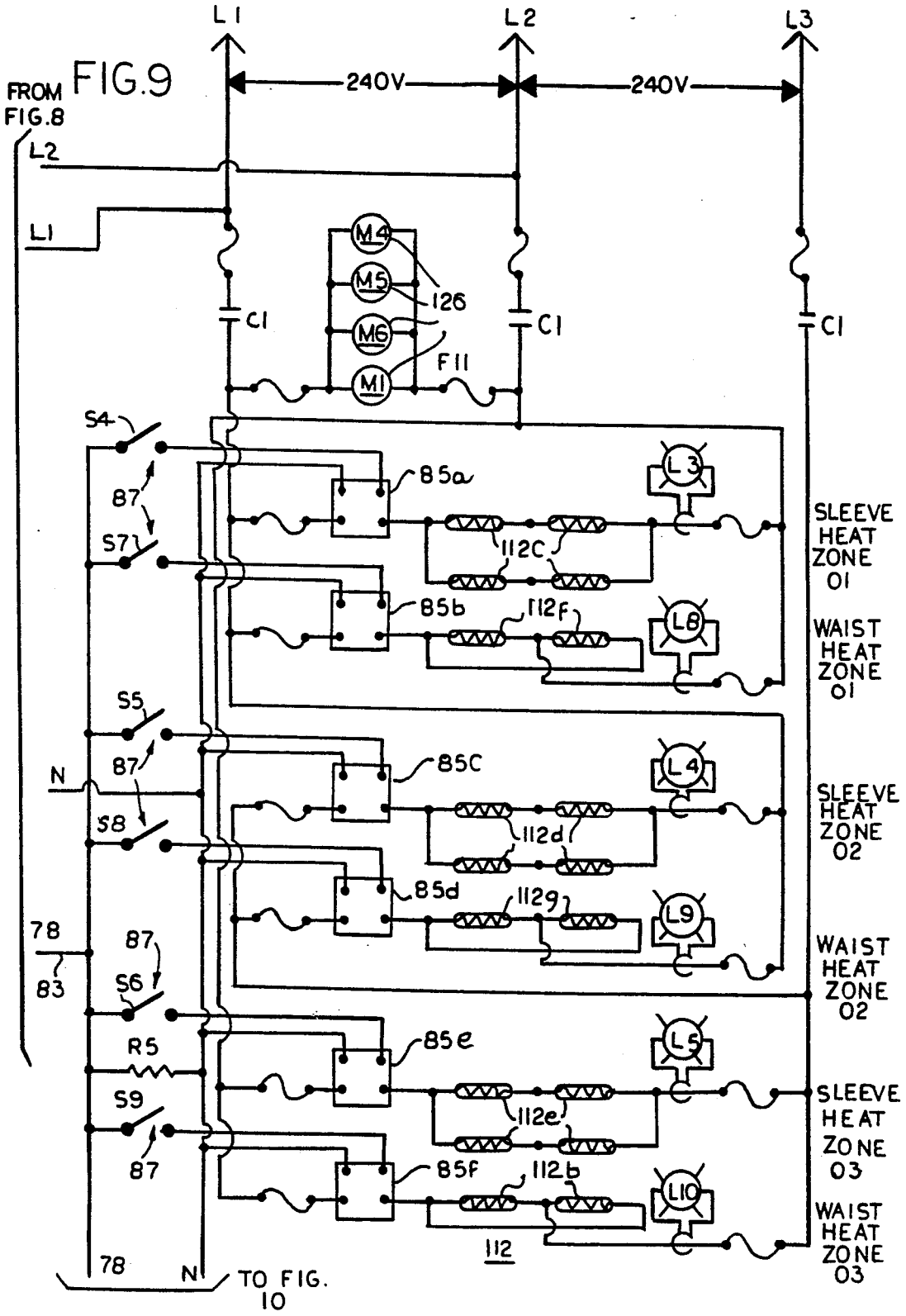
FIGS. 9 and 10 are schematic circuit diagrams of the heating elements of the curing apparatus.
Figure 10:
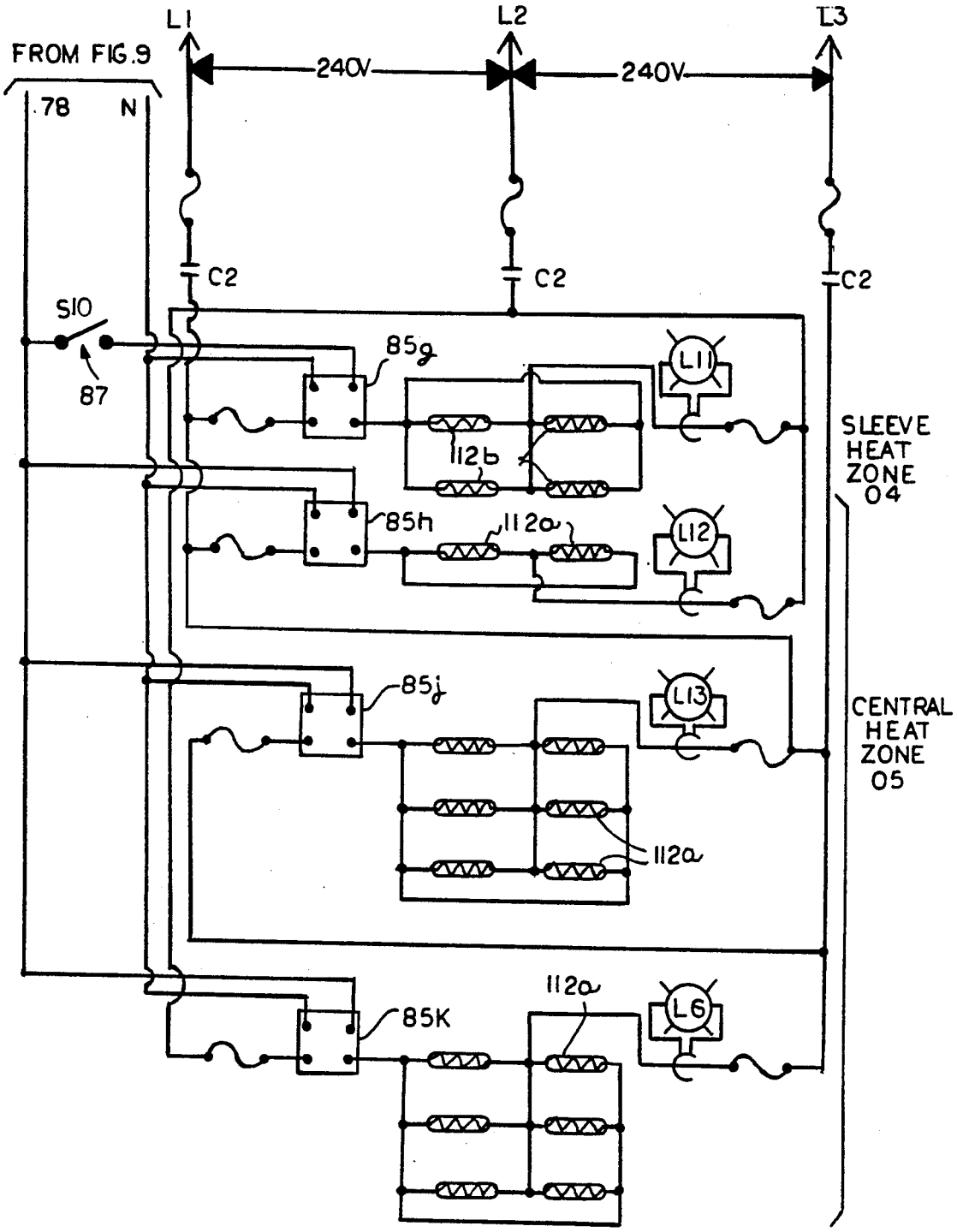

Referring to FIG. 8 of the drawings, there is shown the circuit diagram of a heating element controller 65 which regulates the power to the heating elements 112. The circuit diagrams of FIGS. 9 and 10 show the circuit connections for the heating elements 112*a*–112*g* as discussed above in connection with the element layout shown in FIG. 7. The apparatus 10 is operated from a three phase 240 volt power supply. A transformer 67 provides 120 volt power to the controller 65.

In order to reduce the heat-up time for the heating elements 112, it is desired to apply full power to the elements initially and then operate at a reduced power level thereafter until the power to the elements is interrupted, causing them to cool down. To accomplish this objective, there is provided a temperature controller 69 which has a thermocouple 71 disposed adjacent to quartz tubes 112 as shown in FIG. 6. The temperature controller 69 is adjustable to set a preselected temperature at which controller switch contacts 73 will be closed. A set point temperature of on the order of 400° F. has been found to be slightly above the temperature sensed under normal curing conditions and functions well as a cutoff temperature for the full power heat-up of the elements. With the thermocouple located one quarter inch below the quartz tubes 112 and three quarters of an inch from the material 22, the material temperature will be on the order of 300° F. at the cutoff by the controller, which is suitable for curing. Closure of the contacts 73 allows current flow through the portion of the circuit including the coil 75 of the relay K-4, which is a double pole relay having two sets of contacts, one being holding contacts 77 connected in parallel with temperature controller contacts 73.

The controller 65 includes a proportional power control 79 which is capable of supplying power to the heating elements 112 at any level which may be a percentage of the full power. The power control 79 comprises a phase angle type of solid state control 79*a* having a potentiometer 79*b* with an adjustable tap calibrated in percent of full power. Connected in the circuit for the tap of potentiometer 79*b* is a switch 81 which is the second set of switch contacts in the K-4 relay operated by coil 75. Thus, when controller 65 is initially energized and the temperature controller 69 has not yet closed the circuit energizing the K-4 relay, the tap of the potentiometer is disconnected by the open switch 81. This condition allows full power to flow to the heating elements 112, as will be explained below. Once the contacts 81 have been closed by relay K-4 when the temperature controller 69 has sensed the heating element attaining the set point temperature, the potentiometer setting reduces the power flow to the heating elements to the selected percentage of full power.

To accomplish this control of power to the heating elements, the control 79*a* is connected to operate a solid state relay 79*c* which in turn connects power through line 83 to a series of solid state relays 85*a*–85*k* to control the power to the various series of quartz elements 112, as shown in FIGS. 9 and 10. In the line 83 before the solid state relays 85*a*, 85*b*, 85*c*, 85*d*, 85*e*, 85*f* and 85*g*, there are switches 87 which provide the opportunity to select which of the various groups of heating elements 112 shall be energized in any curing operation. If all the switches 87 are open, only the heating elements 112*a* will be energized. Closing any of the switches 87 will result in the heating elements connected to the relays 85*a* to 85*g* being energized in addition to the elements of the central heating zone. Thus, the power control 79 will supply power at a preselected level or a percentage of full power to the array of heating elements 112 as determined by the settings of the various switches 87 associated with the groups of selectively operable elements.

The curing cycle of the present invention as regulated by controller 65 will take place over the entire period during which the workpiece remains in the curing station, since the heating elements will be on continuously while operating at a reduced power level, to provide the required curing during that period of time. The power control 79 provides a simple potentiometer setting to select the power level as a percent of full power. With normal cycle times of 4 to 7 seconds, this power level is normally between 30 and 50 percent of full power. As shown in FIG. 8, the blower 126 is connected in parallel with control 79 to the secondary of transformer 67 so that it is continuously operated. Other blowers 126 are shown in FIG. 9 connected directly across the input supply L1–L2. The continuous operation of the cooling fans or blowers provides more even heat distribution across the material 22 and eliminates any problems with residual heat build-up during short interruptions in the normal cycling of the apparatus, even though the heating elements are operated continuously.

However, there will be occasions when the normal cycling of the apparatus is interrupted or delayed, at which time it is desirable to have means for automatically interrupting the operations of the heating elements even though they are operating at a reduced power level. In order to accomplish this automatic shutdown of the heating elements, there is provided a time switch 89, which is connected in series with normally closed relay contacts 91 controlled by coil 93 of the relay K-3. The coil 93 of relay K-3 is connected in series with manual start switch 94 so that the coil 93 is initially energized opening the switch 91 which maintains the time switch 89 de-energized.

The relay coil 93 of relay K-3 is maintained energized until the indexing of the screen printing apparatus 23 is interrupted, causing the relay K-3 to drop, closing the switch 91 providing power to the time switch 89 which begins its time-out cycle, which is 4 to 7 seconds. If the indexing of the screen printing apparatus has not resumed providing the signal to energize relay K-3, the time switch 89 will time out, causing a normally closed switch 95 to open. The switch 95 is in series across the line with the power control 79*a* so that opening of the switch 95 cuts off power to the heating elements 112. Thereafter, any reenergization of the heating elements 112 requires the rapid start-up sequence involving full power to heating elements until the set point for the temperature controller is attained by the thermocouple 71. Even after shutdown of the heating elements 112, one of the fans 126 will remain energized by the transformer 67. As shown in FIG. 9, the additional fans 126 are connected in circuit for continuous operation independent of the control exerted by controller 65 on the energization of the heating elements 112.

Control of the curing apparatus 10 may be accomplished by means of a control panel 60 which may operate the heating elements at the various power levels described above and permitting selection of the portions of the heating elements that would be operable. The control panel 60 includes a set point temperature selector 97 which permits selection of the temperature at which temperature controller 69 actuates relay K-4 to reduce the power supplied to the heating elements. Also included in control panel 60 is a potentiometer control 99 for setting the percent of full power at which the power control 79 is to deliver power to the heating elements. Switch controls 101 for the switches 87 are included on panel 60 for selecting the portions of the heating element 112 which are to operate during any curing operation.

The control panel 60 is operated by electrical signals from the press 23 which are sent to the control panel upon rotation of the platens 20, such that the voltage to the tubes 12 is interrupted upon failure of the press 23 to index properly in rotating the platens 20 from one station to the next. The time switch 89 is employed to de-energize the apparatus 10 after the apparatus has been in an operating position for a predetermined maximum time without receipt of a signal from the press 23 to the control panel 60. The time switch 89 may be mounted on the press 23, as shown in FIG. 1, or incorporated into the control panel, and includes a time delay selector 103 which permits selection of the delay period after which shutdown occurs. Thus, during periods of production interruption, the platens 20 are stationary, so no control signals are sent from the press 23 to the control panel, and the apparatus 10 continues to dwell with heating elements deenergized, with the blowers 126 turned on, until production is resumed. Upon resumption of production, a signal is sent by the press to the control panel 60 upon registration of the platens 20 to return the apparatus to its full power heat-up mode. Electrical power from the control panel is supplied to the quartz tubes 112 and blowers 126 through conventional wiring 62 extending therebetween. The control panel 60 is connectable to each of a plurality of outlets 64, each located at a respective printing head. This allows the apparatus to be simply plugged into the desired outlet 64 at which the apparatus is positioned and be controlled by the control panel 60.

The method and apparatus of the present invention provides a very simple and effective means for curing the workpieces in an automatically indexing screen printing press. By correlating the power level at which the heating elements are operated to the residence time of the workpiece in the curing station, it is possible to operate the heating elements continuously with the indexing of the press controlling the curing time.

The use of the continuously operating cooling fans for the heating elements provides a uniform heat output and avoids any residual heat problems. By designing the heating elements to be operable at a much higher power level than their normal operating level, it is possible to obtain very rapid heat-up initially when operating at full power. By including automatic means for reducing the power to a preselected lower level on reaching the set point temperature, there is no risk of overheating as a consequence of the operator forgetting to switch down the power after the initial heat-up.

The time switch is operative in instances where the indexing exceeds a predetermined time to shut the heating elements down before any overheating occurs. The continuous operation of the cooling fans minimizes the possibility of any overheating occurring even in the event of a faulty or delayed cycling.

Although the invention has been described with respect to various embodiments, it will be understood that there is no intent to limit the invention by such disclosure, but rather it is intended to cover all modifications and alternative constructions falling within the spirit and scope of the invention as defined in the appended claims.

What is claimed is:

1. The combination of a screen printing and a curing apparatus for curing screen printed ink on articles, said combination comprising:

a screen printer having an indexable turntable with platens to carry articles from station to station about a central pivot axis, said articles being stationary at each station for a predetermined period of time;

a plurality of printing heads for screen printing ink on the articles at a printing station;

a curing apparatus at a curing station having electrically powered curing elements for curing ink printed on the articles indexed into the curing station on the turntable;

circuit means for supplying electrical power to the electrically powered curing elements;

manually operable power control means in the circuit means for varying the power to a lower level at a percentage of full power to operate the electrically powered curing elements at a desired operating and curing temperature for curing the ink while the articles are stationary for a predetermined time period;

said power control means having a start circuit for applying a substantially higher level of power to the curing elements to raise said elements toward a temperature substantially higher than the operating temperature to reduce the time needed to warm up the curing elements for the curing; and sensing means for sensing the temperature of the curing elements and for disabling the start circuit and enabling the manually operable control means to return the circuit means to the control of the power control means to operate the electrically powered curing elements at the preselected lower level of power for providing the desired operating and curing temperature.

2. The combination in accordance with claim 1 including a timer means in the circuit means to time out and interrupt the power to the heating elements, and cycle control means responsive to the indexing of a platen and workpiece to generate a control signal to restart the timer means.

3. Heating apparatus for curing stationary articles on an automatically indexing screen printing machine while the articles are stationary, the heating apparatus comprising:

a plurality of electrical resistance heating elements disposed adjacent to an article curing station to radiate heat to an article in said station;

power control means for varying the level of power applied to said heating elements, said power control means operating at a first predetermined high power level in excess of that required to attain an operating temperature for raising the temperature of said heating elements toward the operating temperature and at a second predetermined lower power level;

an interval timer which is adjustable to produce an output after a predetermined time of the curing while the article is stationary;

cycle control means responsive to an article being positioned in said curing station to generate a first control signal to initiate operation of said timer;

said interval timer being connected to said power control to interrupt power to said heating elements after said predetermined time interval.

4. Heating apparatus for curing articles in accordance with claim 3 including temperature responsive means heated by said heating elements to generate a second control signal upon said temperature responsive means attaining a predetermined temperature, said temperature responsive means connected to supply said second control signal to said power control means to switch said power control means to operate at said second predetermined lower power level.

5. Heating apparatus for curing articles in accordance with claim 4 wherein said power control means includes a proportional control whereby said lower power level is variable as a percentage of said high power level with a potentiometer circuit.

6. Heating apparatus for curing articles in accordance with claim 5 wherein said temperature responsive means includes a relay actuated to produce said second control signal to connect said potentiometer circuit to said proportioned control to provide said lower power level.

7. Heating apparatus for curing articles in accordance with claim 3 wherein said machine is a machine for imprinting resin material in the form of designs on clothing articles, said machine having platens which are indexed from printing stations into said curing station, said heating elements being elongated and being disposed in spaced parallel relation to said article supporting platen;

said heating elements being selectively connectable to said power control means to vary the area of said platen being heated in accordance with the size of the design being cured.

8. Heating apparatus for curing articles on an automatically indexing machine in accordance with claim 7 wherein said heating elements are elongated resistance heating elements, housing means for enclosing said heating elements with said housing being open on a side facing said article supporting platen, and fan means circulating cooling air into said housing means and across said platen.

9. Apparatus for heat curing ink applied to a substrate comprising:

a screen printer for printing heat curable ink on each substrate movable sequentially through a series of printing stations at which ink is applied to the substrate;

a frame;

electrical resistance heating elements mounted on said frame in proximity to a substrate supported in a curing station to cure said paint;

control means for supplying electrical power to said heating elements at a first predetermined high level which would raise the heating elements to a temperature in excess of the curing temperature during heat-up of said elements and at a second predetermined lower level suitable for curing after said heating elements have attained a predetermined curing temperature;

substrate transfer means on the screen printer for moving said substrate from a printing station into said curing station at which the substrate is stationary and, after a predetermined interval of being stationary, moving said substrate out of said curing station;

an interval timer which is initiated on failure of said substrate transfer means to transfer the stationary article within a predetermined time, said timer being connected to said control means to interrupt power to said heating elements a predetermined time after failure of said transfer means.

10. Apparatus for heat curing paint in accordance with claim 9 wherein said control means supplies electrical power continuously at said lower level as long as said transfer means moves said substrate out of said curing station in said predetermined interval, with fan means circulating cooling air between said heating elements and said substrate in the curing station.

11. Apparatus for heat curing paint in accordance with claim 10 wherein said control means includes a temperature control having a thermocouple responsive to said heating elements to generate a control signal upon attaining a predetermined temperature, said control means including a power control means responsive to said control signal to switch from supplying electrical power at a said high lever to supplying power at said lower level.

12. A method of controlling the heat curing of articles being processed on an automatically indexing screen printing machine comprising:

providing resistance heating elements for raising articles to a curing temperature at a curing station to which articles are supplied;

supplying power to said elements at a first high level to raise said elements to a predetermined elevated curing temperature, said first high level being capable of raising the temperature of said elements to substantially above the curing temperature;

supplying power to said elements at a second preselected lower level after said elements have attained said elevated curing temperature;

transferring articles into and out of said curing station while maintaining each article stationary in said station for a predetermined curing time interval in which the article is stationary; and terminating the application of said second lower level of power responsive to the time an article remains in said curing station exceeding the predetermined time interval.

13. A method of controlling the heat curing of articles in accordance with claim 12 including an interval timer to terminate the supply of power in response to said article remaining in said curing station for more than said preselected indexing time.

14. A method of controlling the heat curing of articles as set forth in claim 13 including the step of selecting the numbers of said heating elements to be powered during a specific curing cycle.

15. A method of controlling the heat curing of articles in accordance with claim 14 wherein initiation of operation of said resistance heating elements caused said power to be supplied at said first high level until said elements have attained said elevated temperature.

16. A method of controlling heat curing of articles in accordance with claim 15 wherein said supply of power to said heating elements is controlled by a solid state proportional control operated at full power to supply said first high level of power and having a rheostat selectively set to provide a percent of full power at said second preselected lower level.

17. A method of controlling heat curing of articles in accordance with claim 16 wherein the terminating of said second lower level of power is accomplished by a relay controlled by said interval timer which opens the circuit to said proportional control on expiration of said preselected time.

* * * * *

UNITED STATES PATENT AND TRADEMARK OFFICE

CERTIFICATE OF CORRECTION

PATENT NO. : 5,239,613

DATED : August 24, 1993

INVENTOR(S) : Motev, et al.

It is certified that error appears in the above-identified patent and that said Letters Patent is hereby corrected as shown below:

Column 2, line 50, change "apparatus" to --Apparatus--.

Column 4, line 16, change "copending" to --co-pending--.

Column 5, lines 57-58, change "palettes" to --pallets--.

Column 7, line 18, change "reduce" to --reduced--.

Column 11, line 68, after "for" delete "the".

Column 12, line 35, after "timer"; insert --and--.

Column 13, line 20, change "paint" to --ink--.

Column 13, line 34, after "station," add --and--.

UNITED STATES PATENT AND TRADEMARK OFFICE

CERTIFICATE OF CORRECTION

PATENT NO. : 5,239,613

DATED : August 24, 1993

INVENTOR(S) : Motev, et al.

It is certified that error appears in the above-identified patent and that said Letters Patent is hereby corrected as shown below:

Column 13, line 41, change "paint" to --ink--.

Column 13, line 48, change "paint" to --ink--.

Column 14, line 2, change "lever" to --level--.

Column 14, line 48, change "terminating" to --termination--.

Signed and Sealed this

Seventeenth Day of May, 1994

*Attest:*

Bruce Lehman

BRUCE LEHMAN

*Attesting Officer*

*Commissioner of Patents and Trademarks*